US011918054B2

(12) United States Patent
Dodson et al.

(10) Patent No.: US 11,918,054 B2
(45) Date of Patent: Mar. 5, 2024

(54) SYSTEM, METHOD AND APPARATUS FOR SMOKING DEVICE

(71) Applicant: GRAVITRON, LLC, Austin, TX (US)

(72) Inventors: Travis Dodson, Austin, TX (US); Micah Evans, Austin, TX (US)

(73) Assignee: GRAVITRON, LLC, Austin, TX (US)

( * ) Notice: Subject to any disclaimer, the term of this patent is extended or adjusted under 35 U.S.C. 154(b) by 1081 days.

(21) Appl. No.: 16/745,048

(22) Filed: Jan. 16, 2020

(65) Prior Publication Data

US 2021/0219604 A1 Jul. 22, 2021

(51) Int. Cl.

| | |
|---|---|
| ***A24F 1/28*** | (2006.01) |
| ***A24F 5/10*** | (2006.01) |
| ***A24F 1/32*** | (2006.01) |

(52) U.S. Cl.

CPC ..... *A24F 5/10* (2013.01); *A24F 1/28* (2013.01); *A24F 1/32* (2013.01)

(58) Field of Classification Search

None

See application file for complete search history.

(56) References Cited

U.S. PATENT DOCUMENTS 825,750 A * 7/1906 Neustadtl ..... A24F 9/16 206/244
1,934,115 A * 11/1933 Burns ..... A24F 9/16 131/176
2,283,624 A * 5/1942 Copell ..... A24F 9/16 206/810
3,552,454 A 1/1971 Demming
3,821,958 A * 7/1974 Overleese ..... A24D 1/08 131/174
3,994,305 A 11/1976 Hughes
4,827,827 A 5/1989 Sanfilippo
4,877,067 A 10/1989 Shimokawa et al.
4,884,602 A 12/1989 Yamamoto et al.
4,972,886 A 11/1990 Bernstein
5,081,822 A 1/1992 Boyd et al.
5,321,932 A 6/1994 Sundberg (Continued)

OTHER PUBLICATIONS

Xiamen Better Silicone Rubber Co., Ltd, "Silicone Pipe Sleeve", https://www.grommetseal.com/rubber-sleeve/silicon-sleeve/silicon-pipe-sleeve.html, Google date restricted search: 2019, found on the Internet on Feb. 14, 2023. (Year: 2019).*

(Continued)

*Primary Examiner* — Dionne W. Mayes

(74) *Attorney, Agent, or Firm* — Dickinson Wright PLLC

(57) ABSTRACT

A smoking device can include a tube with an axis, a proximal end, a distal end and a restriction located between the proximal and distal ends. A combustion space is located axially inside the tube between the restriction and the distal end. The combustion space can contain a combustion product. In addition, a sleeve can be removably mounted to an exterior of the tube. The sleeve can be formed from an elastic material and have a storage configuration that can completely encapsulate both the proximal end and the distal end of the tube to seal the tube. The sleeve also can have a use configuration mounted to the proximal end of the tube, and removed from the distal end of the tube to allow air flow through the tube and the sleeve.

30 Claims, 10 Drawing Sheets

(56) References Cited

U.S. PATENT DOCUMENTS

| | | | | |
|---|---|---|---|---|
| 6,148,826 | A * | 11/2000 | Lancaster et al. | A24F 1/00 131/191 |
| 7,530,213 | B2 | 5/2009 | Barrett et al. | |
| 8,534,296 | B2 | 9/2013 | Groff | |
| 8,955,563 | B2 | 2/2015 | Tahil et al. | |
| D761,487 | S | 7/2016 | Han | |
| 9,795,164 | B2 | 10/2017 | Hood | |
| 9,862,519 | B2 | 1/2018 | Deutschle et al. | |
| 9,968,127 | B2 | 5/2018 | Han | |
| 10,071,021 | B2 | 9/2018 | Calvert, II et al. | |
| 2001/0035431 | A1 | 11/2001 | Runft | |
| 2001/0043972 | A1 | 11/2001 | Tomlinson | |
| 2003/0215956 | A1 | 11/2003 | Reed | |
| 2005/0076969 | A1 | 4/2005 | Tahil et al. | |
| 2006/0248857 | A1 | 11/2006 | Senesi | |
| 2008/0216312 | A1 | 9/2008 | Williams et al. | |
| 2009/0288375 | A1 | 11/2009 | Pagani | |
| 2011/0259467 | A1 | 10/2011 | Maness | |
| 2012/0186592 | A1 | 7/2012 | Schleider | |
| 2013/0014471 | A1 | 1/2013 | Tahil et al. | |
| 2013/0014773 | A1* | 1/2013 | Steinberg | A24F 1/28 131/329 |
| 2013/0068348 | A1 | 3/2013 | Sanchez | |
| 2015/0020819 | A1* | 1/2015 | Barrett | A24D 3/067 131/191 |
| 2018/0134423 | A1 | 5/2018 | Narvekar et al. | |
| 2019/0127102 | A1 | 5/2019 | Chudy et al. | |
| 2020/0170295 | A1* | 6/2020 | Grimm et al. | A24F 13/00 |
| 2020/0253271 | A1 | 8/2020 | Peirce et al. | |
| 2021/0051998 | A1* | 2/2021 | Hoch et al. | B29C 45/0001 |

OTHER PUBLICATIONS

"Save a Bowl" Youtube Demonstration, Save a Bowls Youtube Chanel, https://www.youtube.com/watch?v=bhcEW8UVcPw&t=6s, dated Apr. 14, 2014, found on the Internet on Feb. 14, 2023. (Year: 2014).*

Xiamen Better Silicone Rubber Co., Ltd, "Custom Silicone Rubber Sleeve", https://www.better-silicone.com/Custom-Silicone-Rubber-Sleeve-pd6568608.html, dated 2015, found on the Internet on Feb. 14, 2023. (Year: 2015).*

Smokerolla,3.25" Chillum Pipe Silicone Cover Glass Pipe Color Design, https://wholesale.smokerolla.com/collections/hand-pipes-wholesale/products/3-25-chillum-pipe-silicone-cover-glass-pipe-color-design,(AccessedSep. 20, 2019) (Year: 2019).*

The International Searching Authority, Notification of Transmittal of the International Search Report and the Written Opinion of the International Searching Authority dated Apr. 5, 2021, for International Application No. PCT/US21/13402, six pages.

* cited by examiner

SYSTEM, METHOD AND APPARATUS FOR SMOKING DEVICE

CROSS-REFERENCE TO RELATED APPLICATIONS

None.

TECHNICAL FIELD

This application generally relates to devices for smoking a combustible product and, in particular, to a system, method and apparatus for smoking devices.

STATEMENT OF FEDERALLY FUNDED RESEARCH

None.

BACKGROUND OF THE DISCLOSURE

Smoking devices for human consumption of combustion materials commonly include a variety of inhalation delivery devices and methods. For example, rolling papers, hand pipes, water pipes and hookahs offer popular smoking platforms. Although these techniques are workable, improvements in smoking devices continue to be of interest.

SUMMARY OF THE DISCLOSURE

Embodiments of a system, method and apparatus for smoking devices are disclosed. For example, versions can include a smoking device having a tube with an axis, a proximal end, a distal end and a restriction located between the proximal and distal ends. A combustion space can be located axially inside the tube between the restriction and the distal end. The combustion space can be configured to contain a combustion product. In addition, a sleeve can be configured to be removably mounted to an exterior of the tube. The sleeve can include an elastic material having a storage configuration wherein the sleeve is configured to completely encapsulate both the proximal end and the distal end of the tube to seal the tube. The sleeve also can have a use configuration wherein the sleeve is mounted to the proximal end of the tube, and removed from the distal end of the tube to allow air flow through the tube and the sleeve.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

For a detailed description of example embodiments, reference will now be made to the accompanying drawings in which.

DEFINITIONS

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
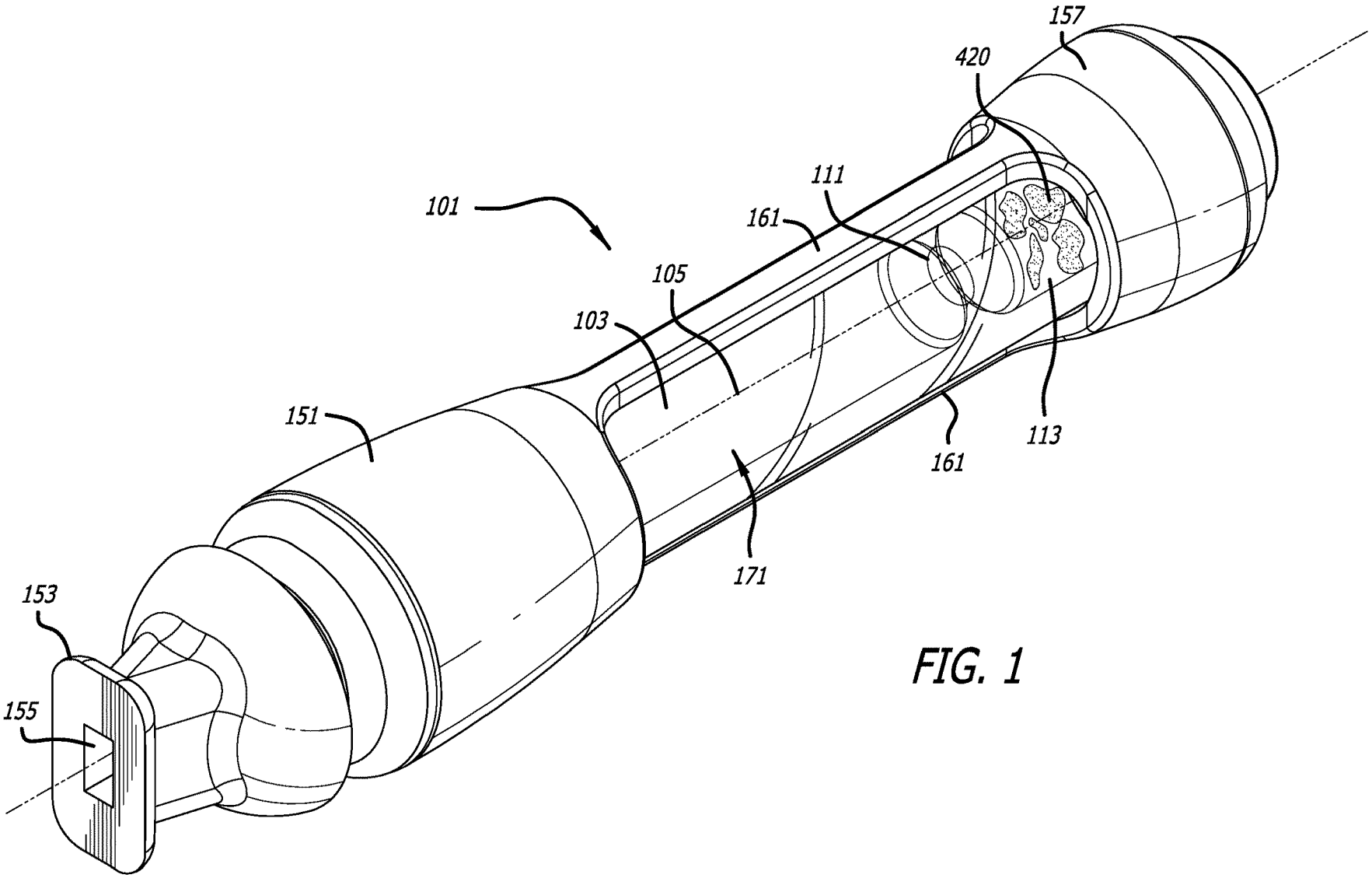
FIG. 1 is a perspective view of an embodiment of a smoking device in a storage configuration.
Figure 2:
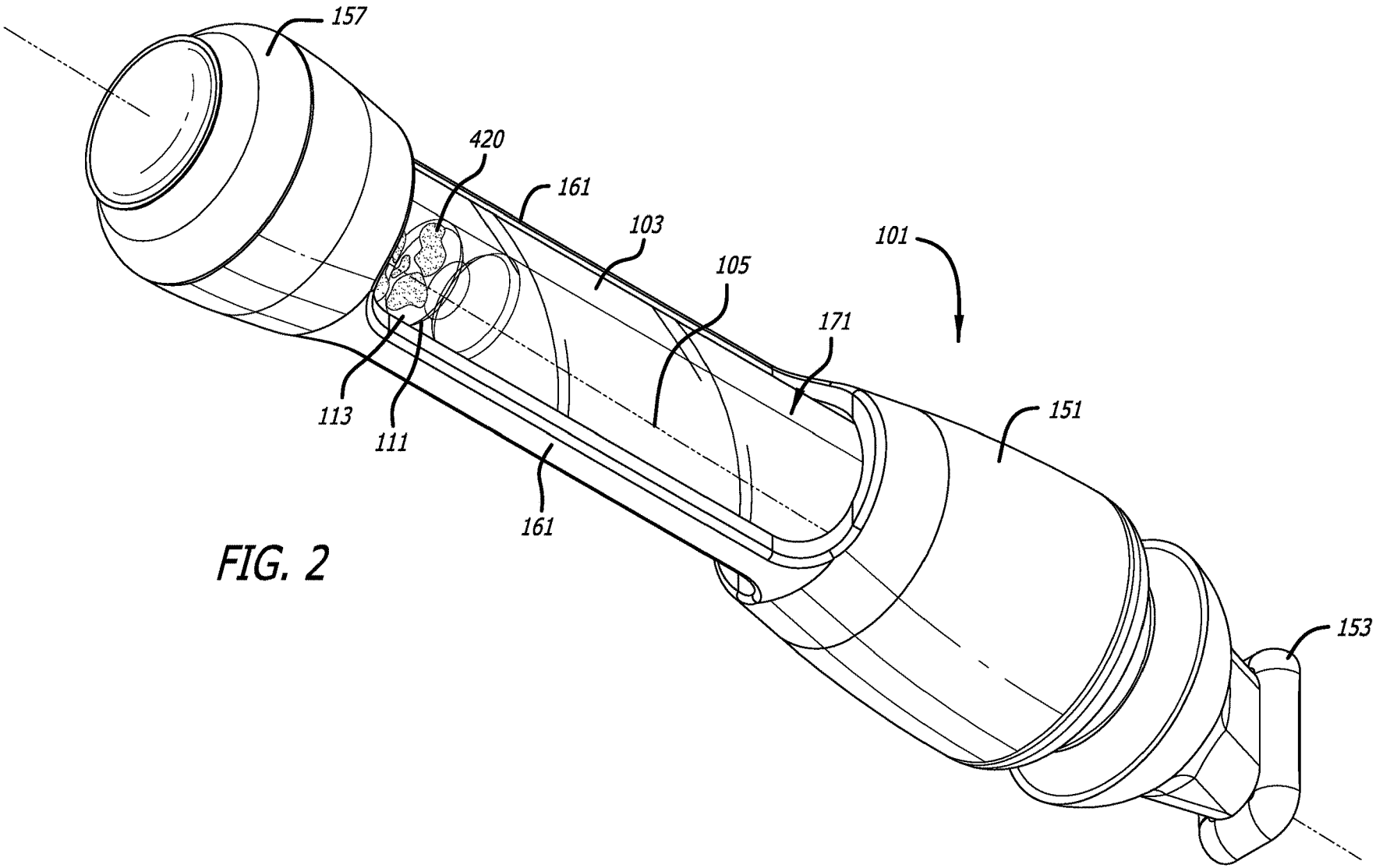
FIG. 2 is a reverse perspective view of the embodiment of FIG. 1.
Figure 3:
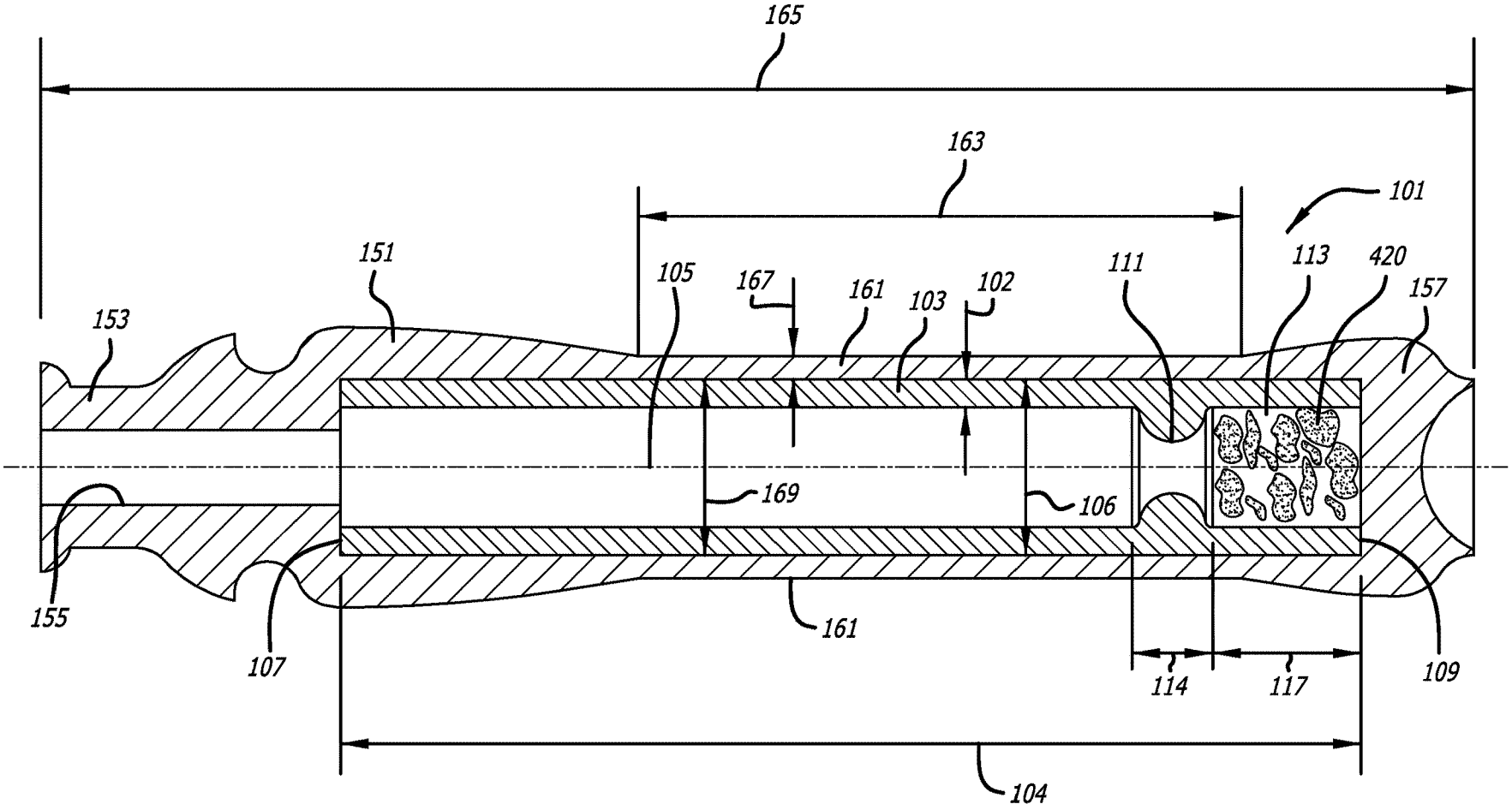
FIG. 3 is a sectional view along an axis of the embodiment of FIG. 1.
Figure 4:
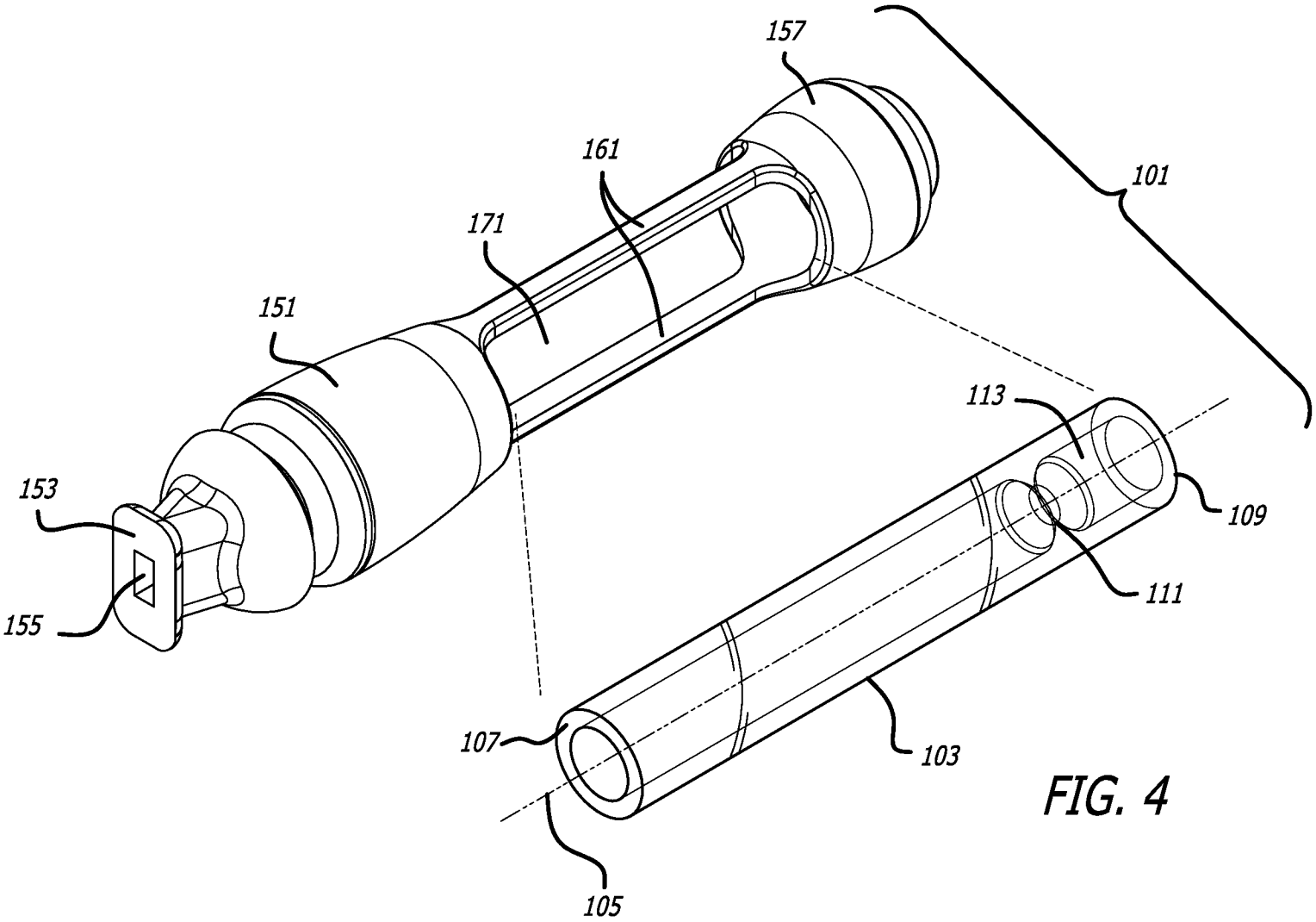
FIG. 4 is a perspective view of a disassembled version of the embodiment of FIG. 1.
Figure 5:
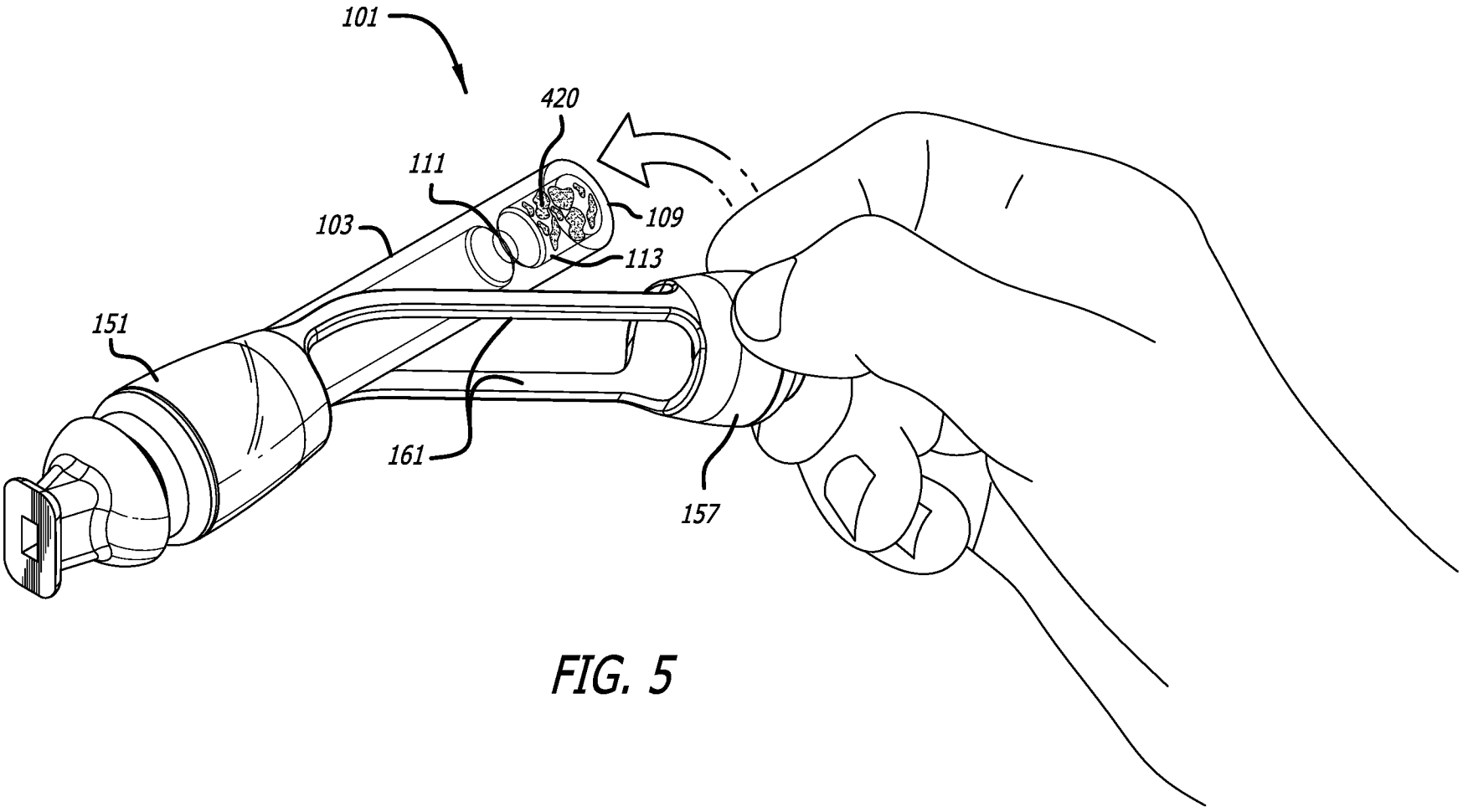
FIG. 5 is a perspective view of a user deploying an embodiment of the smoking device of FIG. 1 from the storage configuration to an operational configuration.
Figure 6:
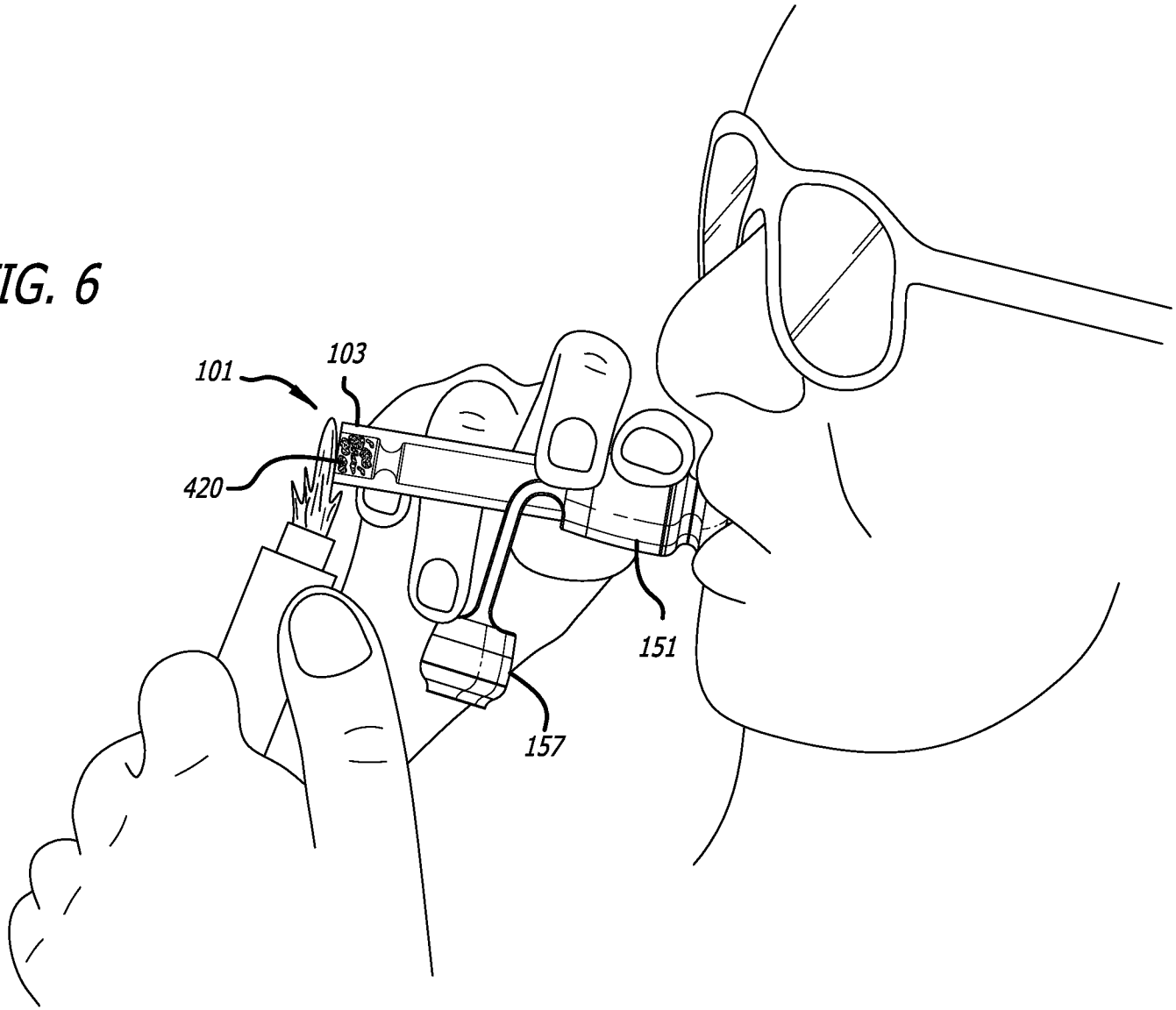
FIG. 6 is a perspective view of the embodiment of FIG. 5 in operation.
Figure 7:
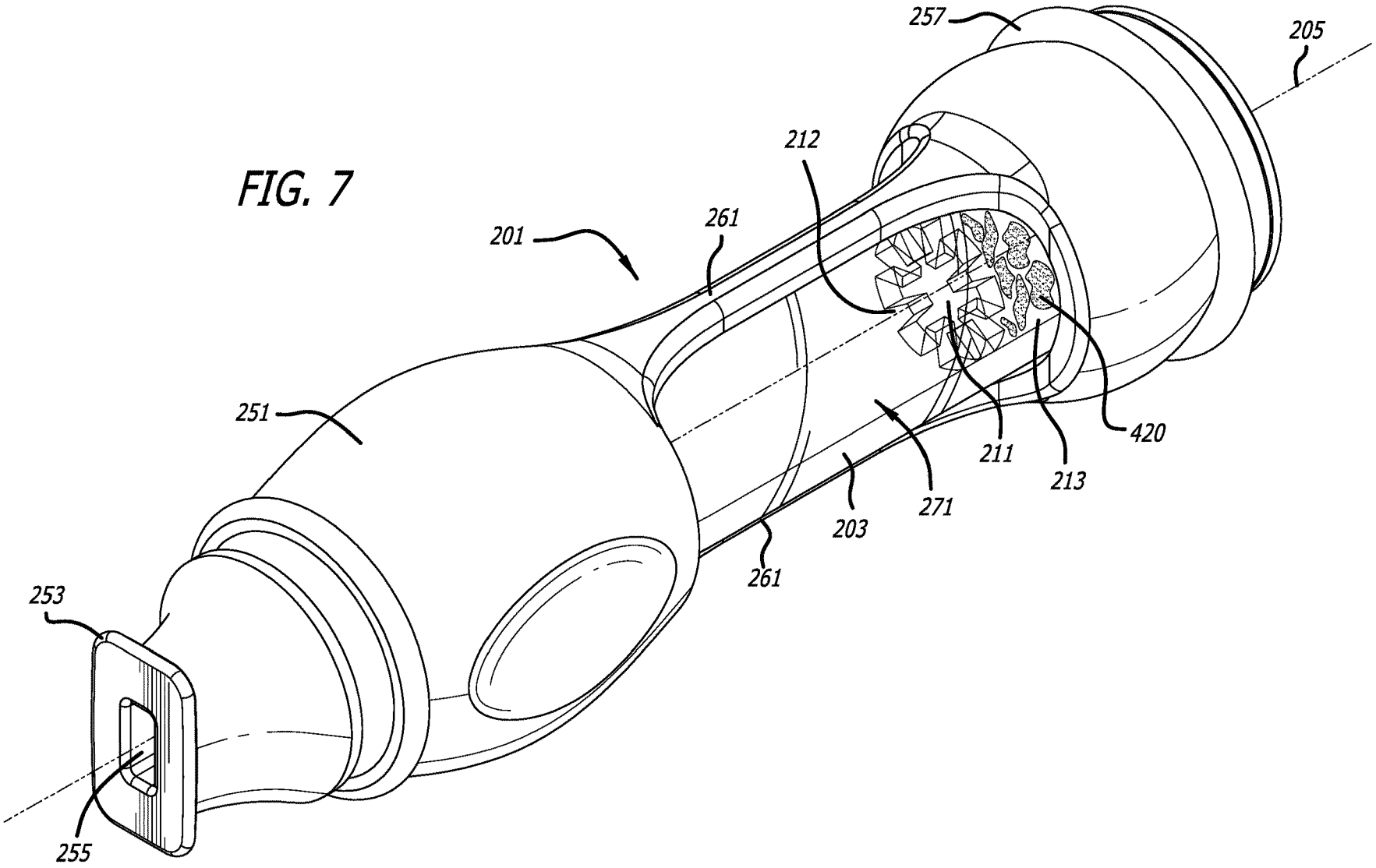
FIG. 7 is a perspective view of a second embodiment of a smoking device in a storage configuration.
Figure 8:
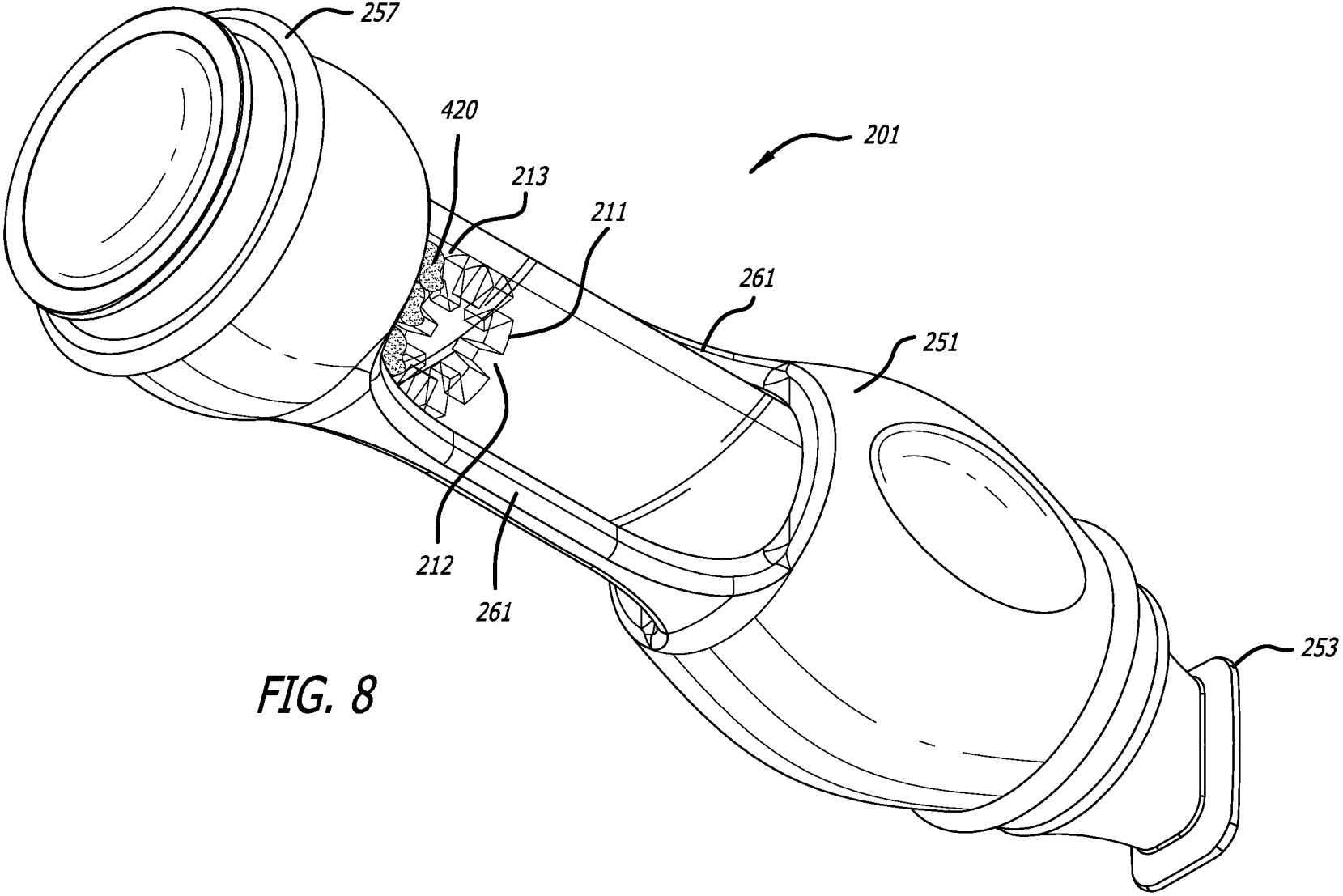
FIG. 8 is a reverse perspective view of the embodiment of FIG. 7.
Figure 9:
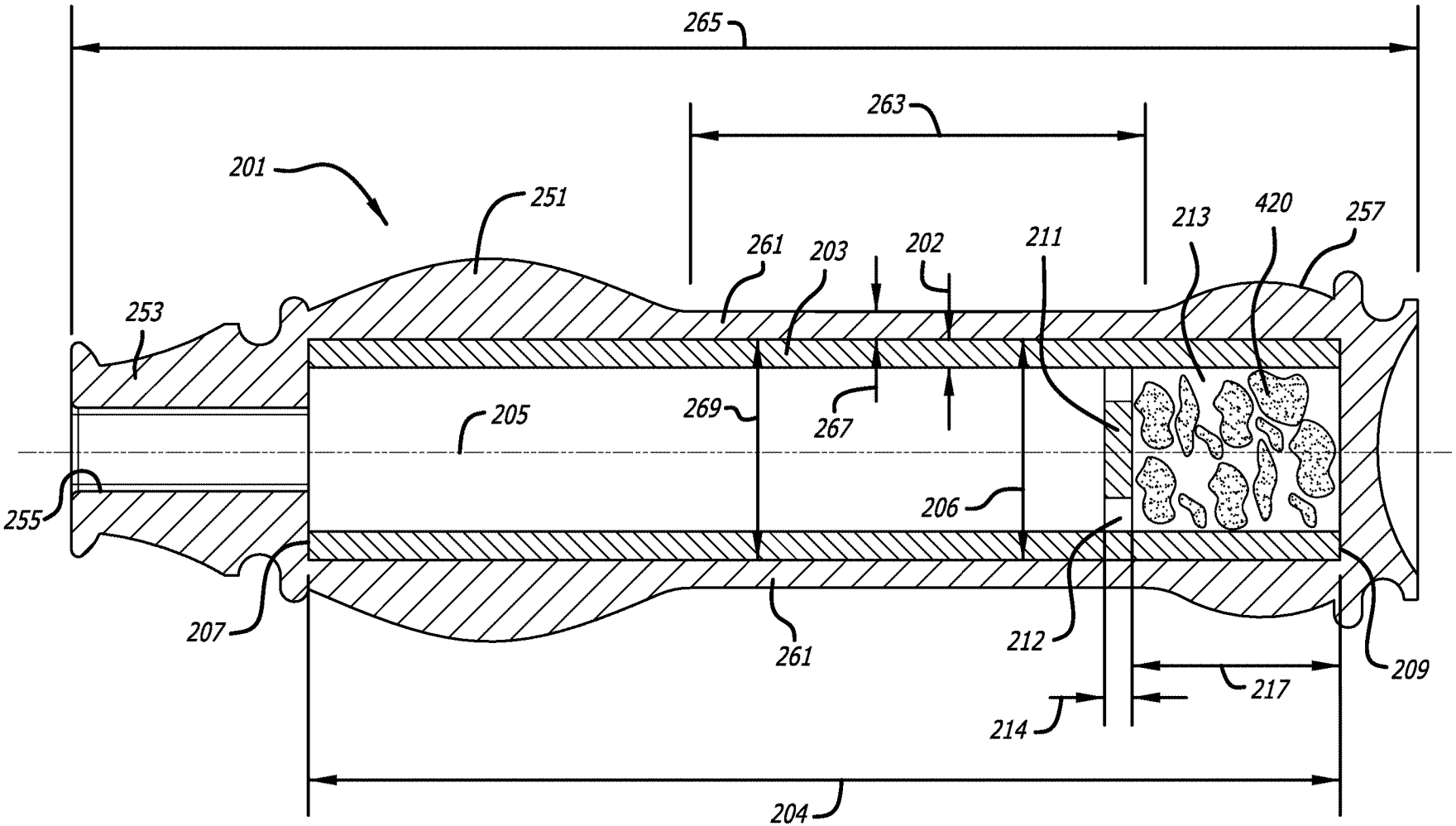
FIG. 9 is a sectional view along an axis of the embodiment of FIG. 7.
Figure 10:
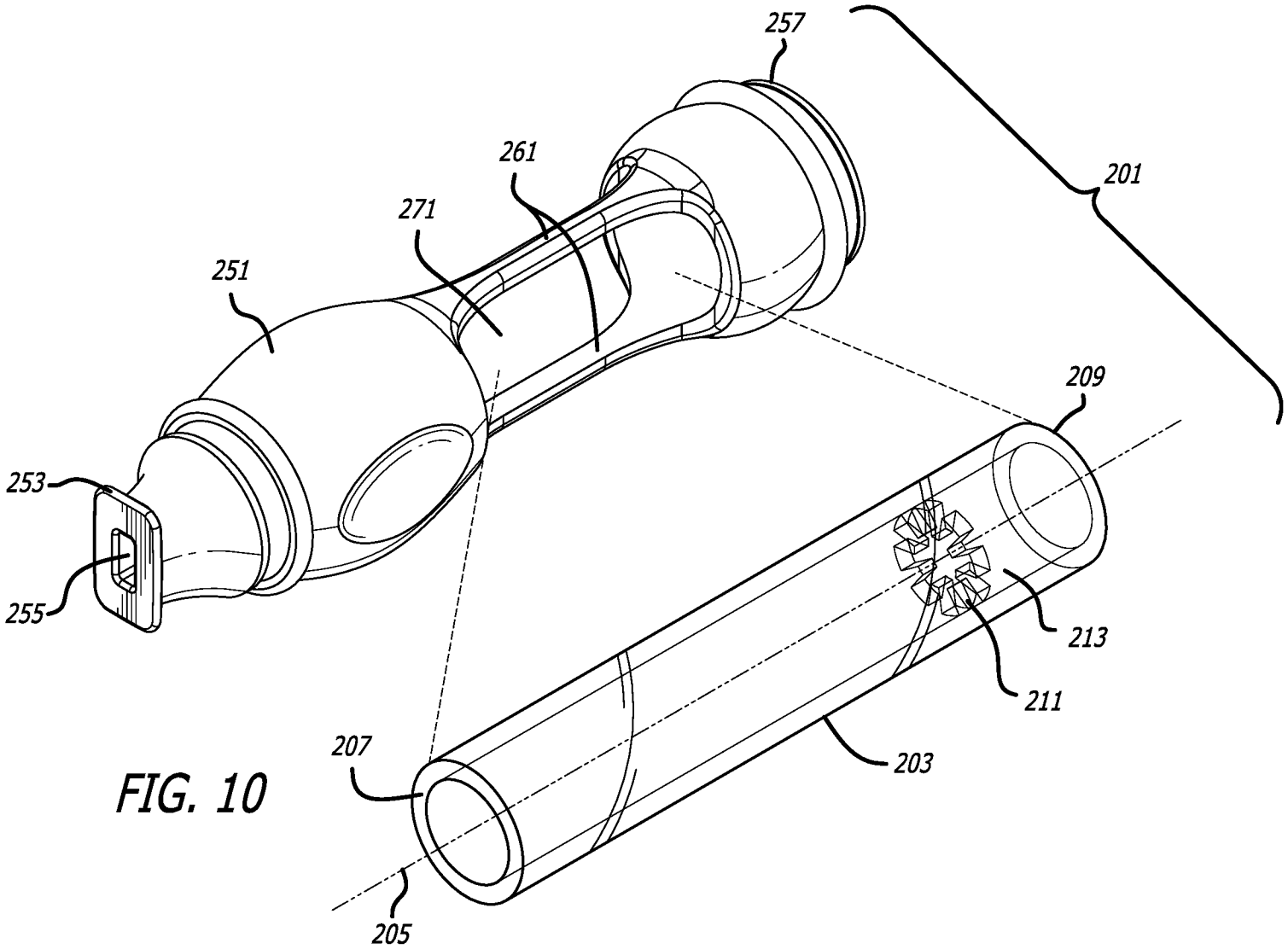
FIG. 10 is a perspective view of a disassembled version of the embodiment of FIG. 7.

FIGS. 1-10 depict embodiments of a system, method and apparatus for a smoking device. For example, the version of the device 101 shown in FIGS. 1-6 can include a tube 103 having an axis 105, a proximal end 107 (FIGS. 3-4) and a distal end 109. Versions of the tube 103 can comprise glass (e.g., borosilicate glass), graphite, metal alloy, ceramic or still other materials. The tube 103 can be generally cylindrical and hollow from the proximal end 107 to the distal end 109. In one example, the tube 103 can consist of a single glass material that is transparent or translucent. Embodiments of the tube 103 can include a tube wall thickness 102 (FIG. 3) that can be about 5% to about 10% of a tube outer diameter 106 of the tube 103.

Embodiments of the tube 103 can further include a restriction 111 located between the proximal and distal ends 107, 109. The restriction 111 can comprise, for example, a reduction in the inner diameter of the tube 103. In the illustrated version, the restriction 111 can include an opening or aperture having an aperture inner dimension that is smaller than an inner diameter of the tube 103. The aperture and the tube 103 can be coaxial. In one example, the restriction 111 can include a generally hourglass shape in an axial direction. Embodiments of the restriction 111 can include a restriction axial length 114 (FIG. 3) that can comprise about 5% to about 10% of a tube axial length 104 of the tube 103. One version of the restriction 111 can be permanently mounted in the tube. For example, the restriction 111 can be glass and integrally formed with the tube 103. In other versions, the restriction 111 can be removably mounted in the tube 103. For example, the restriction can comprise a removable glass or metal screen.

Versions of the tube 103 can include a combustion space 113 located inside the tube 103. For example, the combustion space 113 can be located axially between the restriction 111 and the distal end 109. Embodiments of the combustion space 113 can be configured to contain a combustion product 420. Versions of the combustion space 113 can include an axial length 117 (FIG. 3) that can be about 10% to about 20% of the tube axial length 104 of the tube 103. Embodiments of the device 101 also can include a skin or sleeve 151 that can be configured to be removably mounted to the tube 103. Versions of the sleeve 151 can mount only to the exterior of the tube 103, such that the sleeve 151 does not mount to any interior portion of the tube 103. Examples of the sleeve 151 can comprise an elastic material, such as silicone or rubber materials. One version of the sleeve 151 can consist of a single silicone material. In other versions, the sleeve 151 can comprise an inelastic or more rigid material, such as a polymer, metal, etc. In one example, the sleeve 151 can be movably (e.g., hingably) or removably coupled to the distal end 109 of the tube 103.

In some versions, the device 101 can include a storage configuration (FIGS. 1-3) wherein the sleeve 151 is configured to completely encapsulate both the proximal end 107 and the distal end 109 of the tube 103. Examples of the storage configuration can seal the tube 103 to prevent combustion (e.g., airflow) within it. In the storage configuration, the sleeve 151 can be configured to not entirely capsulate a remainder of the tube 103 such that the tube 103 is still visible from an exterior of the sleeve 151 in the storage configuration. For example, in some embodiments of the storage configuration, the restriction 111 and the combustion space 113 can be visible from an exterior of the sleeve 151.

In addition, embodiments of the device 101 can include an operational or use configuration (FIGS. 5-6) wherein the sleeve 151 can be mounted to the proximal end 107 of the tube 103 and removed from the distal end 109 of the tube 103. The use configuration can allow air flow through the tube 103 and the sleeve 121, such as for combustion.

Embodiments of the sleeve 151 can include a mouthpiece 153. The mouthpiece 153 can be configured to receive, attach and seal to an exterior of the proximal end 107 of the tube 103 in both the storage and use configurations, as shown. Versions of the mouthpiece 153 can include a fluid conduit 155 configured to be in fluid communication with an interior of the tube 103 in the use configuration.

Versions of the sleeve 151 can include a cap 157. The cap 157 can be configured to receive, removably attach and seal to the distal end 109 of the tube 103 in the storage configuration. In the storage configuration, the cap 157 can be configured to restrain or confine the combustion product 420 in the combustion space 113 of the tube 103.

In addition to the mouthpiece 153 and cap 157, the sleeve 151 can include one or more elastic members 161 (e.g., two shown). The elastic members 161 can extend between the mouthpiece 153 and the cap 157. In the illustrated version, the elastic members 161 comprise a pair of elastic bands on opposite sides of the sleeve 151. Examples of the elastic members 161 can include a band axial length 163 (FIG. 3) that can be about 30% to about 50% of a sleeve axial length 165 of the sleeve 151. Versions of the elastic members 161 can include a band radial thickness 167 that can be about 10% to about 20% of a sleeve inner diameter 169 of the sleeve 151. Embodiments of the sleeve 151 can include one or more windows 171 (e.g., two shown) located circumferentially between the elastic members 161. The windows 171 also can be located axially between the mouthpiece 153 and the cap 157.

FIGS. 7-10 depict another embodiment of a device 201. Device 201 can be similar to device 101, and almost identical or identical in some aspects and functionality. For ease of understanding, the reference numerals 2*xx* for device 201 mimic the reference numerals 1*xx* of device 101. For example, device 201 can include a tube 203 like device 101 includes the tube 103.

Embodiments of device 201 and tube 203 can further include an axis 205, proximal end 207, distal end 209, tube wall thickness 202, tube outer diameter 206, restriction 211 with restriction axial length 214, and a combustion space 213 with an axial length 217 for a combustion product 420. Versions of the device 201 also can include a sleeve 251 with a mouthpiece 253 and fluid conduit 255, cap 257, elastic members 261 with a band axial length 263, sleeve axial length 265, band radial thickness 267, sleeve inner diameter 269 and windows 271.

Some embodiments of device 201 can include features that differ from device 101. For example, the restriction 211 can comprise a screen having a plurality of apertures 212. The screen can comprise a solid axial portion and solid radial spokes extending to an inner surface of the tube 203. One or more apertures 212 (e.g., several shown) can be located between adjacent ones of the solid radial spokes of the restriction 211. In some versions, the restriction 211 can have a restriction axial length 214 comprising about 2% to about 5% of a tube axial length 204 of the tube 203. In addition, the tube 203 can have a tube wall thickness 202 that is about 10% to about 15% of a tube outer diameter 206 of the tube 203.

Other attributes and features of the embodiments disclosed herein can include a protected, durable device that can withstand rough handling, such as being thrown across a room without breaking. The elastic outer sleeve or skin on the device can be bouncy and shock-absorbent like rubber. The pinched mouthpiece can act as an ash catcher, and the cap at the end of the device can keep combustion product in place. These qualities can enable the assembly to be truly pocketable and portable. The entire elastic outer skin or sleeve can be readily removed from the tube for easy cleaning. The end cap can be peeled back from the end of the tube during use. Some versions can eliminate a normal restriction by equipping the device with a glass screen for an extra layer of filtration.

Other embodiments can include one or more of the following features.

1. A smoking device, comprising:
   - a tube comprising an axis, a proximal end, a distal end and a restriction located between the proximal and distal ends, wherein a combustion space is located axially inside the tube between the restriction and the distal end, and the combustion space is configured to contain a combustion product; and
   - a sleeve configured to be removably mounted to an exterior of the tube, the sleeve comprises a storage configuration wherein the sleeve is configured to completely encapsulate both the proximal end and the distal end of the tube to seal the tube, and a use configuration wherein the sleeve is mounted to the proximal end of the tube and removed from the distal end of the tube to allow air flow through the tube and the sleeve.

2. The smoking device of any of these embodiments, wherein the tube comprises a glass tube that is generally cylindrical and hollow from the proximal end to the distal end.
3. The smoking device of any of these embodiments, wherein the tube consists of a single glass material that is transparent or translucent.
4. The smoking device of any of these embodiments, wherein the combustion space comprises an axial length comprising about 10% to about 20% of a tube axial length of the tube.
5. The smoking device of any of these embodiments wherein, in the storage configuration, the restriction and the combustion space are visible from an exterior of the sleeve.
6. The smoking device of any of these embodiments, wherein the restriction comprises an aperture having an aperture dimension that is smaller than an inner diameter of the tube.
7. The smoking device of any of these embodiments, wherein the aperture and the tube are coaxial, and the restriction comprises a generally hourglass shape in an axial direction.
8. The smoking device of any of these embodiments, wherein the restriction comprises a restriction axial length comprising about 5% to about 10% of a tube axial length of the tube.
9. The smoking device of any of these embodiments, wherein the tube has a tube wall thickness that is about 5% to about 10% of a tube outer diameter of the tube.
10. The smoking device of any of these embodiments, wherein the restriction comprises a screen having a plurality of the apertures.
11. The smoking device of any of these embodiments, wherein the screen comprises a solid axial portion and solid radial spokes extending to an inner surface of the tube, and the plurality of apertures are located between adjacent ones of the solid radial spokes.
12. The smoking device of any of these embodiments, wherein the restriction comprise a restriction axial length comprising about 2% to about 5% of a tube axial length of the tube.
13. The smoking device of any of these embodiments, wherein the tube has a tube wall thickness that is about 10% to about 15% of a tube outer diameter of the tube.
14. The smoking device of any of these embodiments, wherein the sleeve comprises an elastic material.
15. The smoking device of any of these embodiments, wherein the sleeve consists of a single silicone material.
16. The smoking device of any of these embodiments, wherein the sleeve mounts only to the exterior of the tube and the sleeve does not mount to any interior portion of the tube.
17. The smoking device of any of these embodiments, wherein, in the storage configuration, the sleeve is configured to not entirely capsulate a remainder of the tube such that the tube is visible from an exterior of the sleeve.
18. The smoking device of any of these embodiments, wherein the sleeve comprises a mouthpiece configured to receive, attach and seal to an exterior of the proximal end of the tube in both the storage and use configurations.
19. The smoking device of any of these embodiments, wherein the mouthpiece comprises a fluid conduit configured to be fluid communication with an interior of the tube in the use configuration.
20. The smoking device of any of these embodiments, wherein the sleeve comprises a cap configured to receive, attach and seal to the tube in the storage configuration.
21. The smoking device of any of these embodiments wherein, in the storage configuration, the cap is configured to restrain the combustion product in the combustion space of the tube.
22. The smoking device of any of these embodiments, wherein the sleeve comprises a mouthpiece, a cap and an elastic member extending between the mouthpiece and the cap.
23. The smoking device of any of these embodiments, wherein the elastic member comprises a pair of elastic bands on opposite sides of the sleeve.
24. The smoking device of any of these embodiments, wherein each elastic band comprises a band axial length that is about 30% to about 50% of a sleeve axial length of the sleeve.
25. The smoking device of any of these embodiments, wherein each elastic band comprises a band radial thickness that is about 10% to about 20% of a sleeve inner diameter of the sleeve.
26. The smoking device of any of these embodiments, wherein the sleeve comprises a pair of windows located axially between the mouthpiece and the cap.
27. The smoking device of any of these embodiments, wherein the restriction is permanently mounted in the tube.
28. The smoking device of any of these embodiments, wherein the restriction is removably mounted in the tube.
29. The smoking device of any of these embodiments, wherein the restriction comprises glass or metal.
30. The smoking device of any of these embodiments, wherein the sleeve is movably coupled to the distal end of the tube.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The term "discreet," as well as derivatives thereof, references to the amount of skin exposed by a user of the garment, rather than the type of style of the garment. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. As used herein, the terms "substantial" and "substantially" means, when comparing various parts to one another, that the parts being compared are equal to or are so close enough in dimension that one skill in the art would consider the same. Substantial and substantially, as used herein, are not limited to a single dimension and specifically include a range of values for those parts being compared. The range of values, both above and below (e.g., "+/−" or greater/lesser or larger/smaller), includes a variance that one skilled in the art would know to be a reasonable tolerance for the parts mentioned.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A smoking device, comprising:

a tube comprising an axis, a proximal end, a distal end and a restriction located between the proximal and distal ends, wherein a combustion space is located axially inside the tube between the restriction and the distal end, and the combustion space is configured to contain a combustion product; and a sleeve configured to be removably mounted to an exterior of the tube, the smoking device comprising a storage configuration wherein the sleeve is configured to completely encapsulate both the proximal end and the distal end of the tube to seal the tube, and a use configuration wherein the sleeve is mounted to the proximal end of the tube and removed from the distal end of the tube to allow air flow through the tube and the sleeve.

2. The smoking device of claim 1, wherein the tube comprises a glass tube that is generally cylindrical and hollow from the proximal end to the distal end.

3. The smoking device of claim 1, wherein the tube consists of a single glass material that is transparent or translucent.

4. The smoking device of claim 1, wherein the combustion space comprises an axial length comprising about 10% to about 20% of a tube axial length of the tube.

5. The smoking device of claim 1 wherein, in the storage configuration, the restriction and the combustion space are visible from an exterior of the sleeve.

6. The smoking device of claim 1, wherein the restriction comprises an aperture having an aperture dimension that is smaller than an inner diameter of the tube.

7. The smoking device of claim 6, wherein the aperture and the tube are coaxial, and the restriction comprises a generally hourglass shape in an axial direction.

8. The smoking device of claim 7, wherein the restriction comprises a restriction axial length comprising about 5% to about 10% of a tube axial length of the tube.

9. The smoking device of claim 7, wherein the tube has a tube wall thickness that is about 5% to about 10% of a tube outer diameter of the tube.

10. The smoking device of claim 1, wherein the restriction comprises a screen having a plurality of apertures.

11. The smoking device of claim 10, wherein the screen comprises a solid axial portion and solid radial spokes extending to an inner surface of the tube, and the plurality of apertures are located between adjacent ones of the solid radial spokes.

12. The smoking device of claim 10, wherein the restriction comprises a restriction axial length comprising about 2% to about 5% of a tube axial length of the tube.

13. The smoking device of claim 10, wherein the tube has a tube wall thickness that is about 10% to about 15% of a tube outer diameter of the tube.

14. The smoking device of claim 1, wherein the sleeve comprises an elastic material.

15. The smoking device of claim 1, wherein the sleeve consists of a single silicone material.

16. The smoking device of claim 1, wherein the sleeve mounts only to the exterior of the tube and the sleeve does not mount to any interior portion of the tube.

17. The smoking device of claim 1, wherein, in the storage configuration, the sleeve is configured to not entirely capsulate a remainder of the tube such that the tube is visible from an exterior of the sleeve.

18. The smoking device of claim 1, wherein the sleeve comprises a mouthpiece configured to receive, attach and seal to an exterior of the proximal end of the tube in both the storage and use configurations.

19. The smoking device of claim 18, wherein the mouthpiece comprises a fluid conduit configured to be in fluid communication with an interior of the tube in the use configuration.

20. The smoking device of claim 1, wherein the sleeve comprises a cap configured to receive, attach and seal to the tube in the storage configuration.

21. The smoking device of claim 20 wherein, in the storage configuration, the cap is configured to restrain the combustion product in the combustion space of the tube.

22. The smoking device of claim 1, wherein the sleeve comprises a mouthpiece, a cap and an elastic member extending between the mouthpiece and the cap.

23. The smoking device of claim 22, wherein the elastic member comprises a pair of elastic bands on opposite sides of the sleeve.

24. The smoking device of claim 23, wherein each elastic band comprises a band axial length that is about 30% to about 50% of a sleeve axial length of the sleeve.

25. The smoking device of claim 23, wherein each elastic band comprises a band radial thickness that is about 10% to about 20% of a sleeve inner diameter of the sleeve.

26. The smoking device of claim 22, wherein the sleeve comprises a pair of windows located axially between the mouthpiece and the cap.

27. The smoking device of claim 1, wherein the restriction is permanently mounted in the tube.

28. The smoking device of claim 1, wherein the restriction is removably mounted in the tube.

29. The smoking device of claim 28, wherein the restriction comprises glass or metal.

30. The smoking device of claim 1, wherein the sleeve is movably coupled to the distal end of the tube.

* * * * *